US011358693B2

(12) United States Patent
Destino

(10) Patent No.: US 11,358,693 B2
(45) Date of Patent: Jun. 14, 2022

(54) BAR FOR CONTROLLING A KITE

(71) Applicant: BOARDS & MORE GMBH, Molln (AT)

(72) Inventor: Antonio Destino, Oberhaching (DE)

(73) Assignee: BOARDS & MORE GMBH, Molln (AT)

( * ) Notice: Subject to any disclaimer, the term of this patent is extended or adjusted under 35 U.S.C. 154(b) by 92 days.

(21) Appl. No.: 16/971,454

(22) PCT Filed: Feb. 28, 2019

(86) PCT No.: PCT/EP2019/055042

§ 371 (c)(1),
(2) Date: Aug. 20, 2020

(87) PCT Pub. No.: WO2019/166577

PCT Pub. Date: Sep. 6, 2019

(65) Prior Publication Data

US 2020/0398960 A1 Dec. 24, 2020

(30) Foreign Application Priority Data

Mar. 1, 2018 (DE) ..... 102018104743.6

(51) Int. Cl.
*B63H 8/16* (2020.01)
*B63H 8/18* (2020.01)

(52) U.S. Cl.
CPC ..... *B63H 8/16* (2020.02); *B63H 8/18* (2020.02)

(58) Field of Classification Search
CPC ..... B63H 8/16; B63H 8/18
See application file for complete search history.

(56) References Cited

U.S. PATENT DOCUMENTS 2,388,478 A * 11/1945 Garber ..... F41J 9/08 244/155 A
3,075,407 A * 1/1963 Werner ..... F16H 37/00 74/625
3,202,378 A 8/1965 Williamson
4,466,656 A * 8/1984 Igel ..... B60J 7/1642 296/216.02
8,573,540 B2 * 11/2013 Bonieux ..... B63H 8/16 244/155 A
9,567,072 B2 * 2/2017 Enserink ..... B63H 8/16
(Continued)

FOREIGN PATENT DOCUMENTS

DE 19954473 A1 5/2001
DE 202017100070 U1 * 1/2017 ..... B63H 8/16
(Continued)

OTHER PUBLICATIONS

Search Report from German Patent Office dated Jan. 29, 2019 (English translation) (7 pages).
(Continued)

*Primary Examiner* — Christopher D Hutchens
(74) *Attorney, Agent, or Firm* — Mindful IP PLLC

(57) ABSTRACT

A bar for controlling a kite comprises a trimming unit for the control lines (back line trimming unit). A length of the control lines can be adjusted by the trimming unit. The trimming unit is mounted in or on the bar and can be adjusted by means of a motor, preferably an electric motor.

9 Claims, 1 Drawing Sheet

(56) References Cited

U.S. PATENT DOCUMENTS

| | | | | |
|---|---|---|---|---|
| 2002/0040948 | A1* | 4/2002 | Ragner | F03D 13/20 244/153 R |
| 2008/0210826 | A1* | 9/2008 | Ockels | B63H 8/16 244/155 A |
| 2011/0174912 | A1 | 7/2011 | Aharoni | |
| 2014/0034780 | A1* | 2/2014 | Gonzalez | A63H 27/002 244/33 |

FOREIGN PATENT DOCUMENTS

| | | | |
|---|---|---|---|
| DE | 202017100070 | U1 | 1/2017 |
| DE | 112013001598 | B4 | 8/2018 |
| KR | 101500898 | B1 | 3/2015 |
| WO | 2007017744 | A2 | 2/2007 |
| WO | 2011014904 | A1 | 2/2011 |
| WO | 2014101735 | A1 | 7/2014 |

OTHER PUBLICATIONS

International Search Report and Written Opinion for PCT/EP2019/055042 dated Apr. 23, 2019 (12 pages; with English translation).

China National Intellectual Property Administration, First Office Action issued in the corresponding Chinese application, dated Jan. 18, 2022.

* cited by examiner

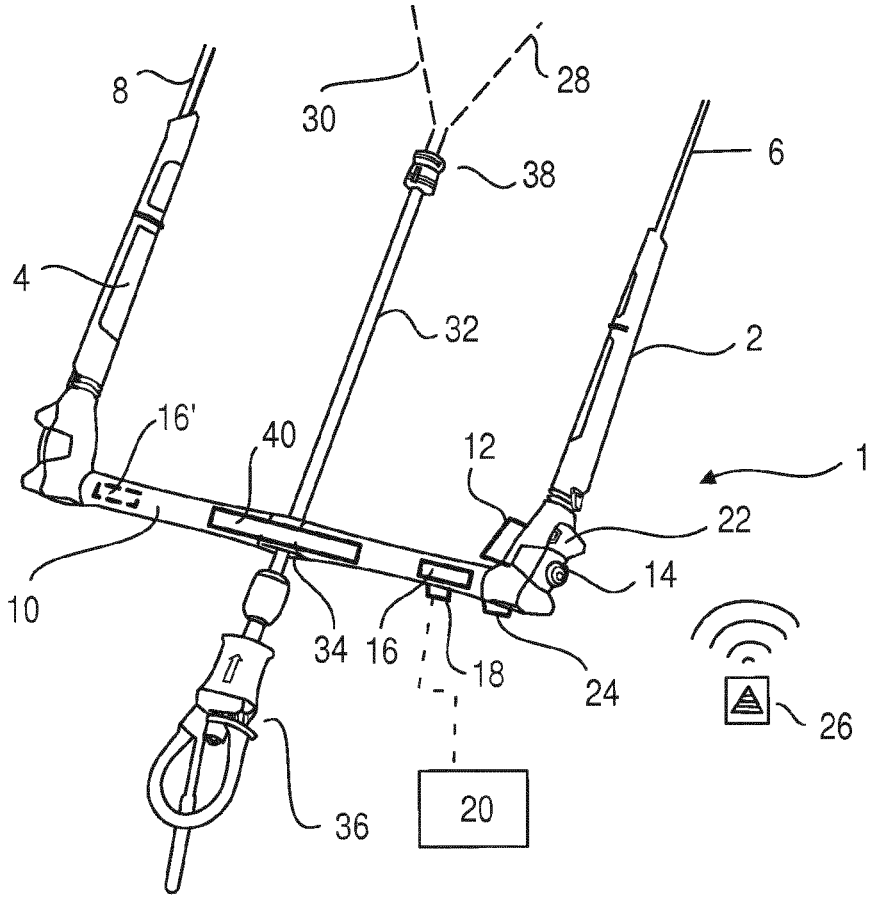
8
30
28
6
38
4
32
2
16'
40
12
1
22
14
10
34
16
18
24
26
36
20

BAR FOR CONTROLLING A KITE

CROSS-REFERENCE TO RELATED APPLICATIONS

This application is a national stage of, and claims priority to, Patent Cooperation Treaty Application No. PCT/EP2019/055042, filed on Feb. 28, 2019, which application claims priority to German Application No. DE 10 2018 104 743.6, filed on Mar. 1, 2018, which applications are hereby incorporated herein by reference in their entireties.

BACKGROUND

The disclosure relates to a bar for steering a kite as disclosed herein.

Such a bar is described, for example, in the printed publication WO 2011/014904 A1. This generic bar can be designed as a 4-line or 5-line bar. The two front lines of a kite converge in a V-shape and are guided through a passage of the bar to a chicken loop. The two back lines of the kite are attached to the end portions of the bar. In conventional solutions, the two front lines or a common trimming line are shortened or extended to trim the kite. In the technically superior solution described in the above-mentioned printed publication, the two back lines are adjusted to trim the kite. In the prior art, this is achieved with a winder/winch at which both back lines are connected, so that by operating the winch, both back lines are synchronously shortened or extended in order to adjust the kite more or less relative to the wind. The winder is actuated by a rotary handle located at one end portion of the bar, which is operatively connected to the winch. The winch has a locking mechanism that prevents the back lines from unwinding due to the pull applied by the kite. A push button is provided for unlocking, which is mounted approximately in the middle of the rotary handle and allows the back lines to be released/extended step by step. This bar is distributed by the applicant under the trademark "Click-Bar®", so that with respect to further details it is referred to the description of this bar.

SUMMARY

Although this bar allows very comfortable and fast trimming of the kite, the disclosure is based on the object to further increase the operating convenience of the bar.

This object is solved by a bar as disclosed herein.

Advantageous further developments are additionally disclosed.

The disclosed bar has two front lines, which are preferably guided through the bar, and two back lines, each connected to one end portion of the bar, the length of which can be adjusted by a winder for trimming the kite. In an example, this winder is adjustable by a motor. This motorized adjustment makes the trimming process even easier as compared to the manual adjustment.

In a further example, the adjustment is carried out by means of an electric motor, which is supplied with energy by a battery.

Both the motor and the battery can be held in or on the bar, wherein it is ensured that the bar remains balanced.

Using the bar is particularly easy when it is configured with a charger connection for connection to a charging station.

Such a charging station can be an accessory of the bar, for example, so that contactless or wired charging is possible.

In a further example, the bar is configured with a radio module by which the winder is adjustable by radio or the like. This design is particularly interesting for instructional courses, since the kite instructor can then take over the trimming of the kite, so that the student is not overwhelmed.

In a further example, the bar is configured with an electric display for displaying essential operating parameters, such as line length and trim parameters and functional parameters.

In order to further improve the operational safety, the bar can also be adjusted by means of an emergency actuation, wherein a rotary handle or a button can be additionally provided. This allows the bar to be adjusted to a basic position, which preferably corresponds to the position with the flattest trim, in the event of a battery failure, for example.

BRIEF DESCRIPTION OF DRAWINGS

FIG. 1 illustrates an example of the bar.

DESCRIPTION

Examples of the bar are explained in more detail below using the single schematic drawing of FIG. 1.

FIG. 1 shows a strongly schematized view of a bar 1 according to the disclosure. The basic structure of the bar 1 is explained in the prior art described at the beginning, so that only the features essential for understanding the disclosure are explained here. Accordingly, the bar 1 has floaters 2, 4 at each of its two end portions, each of which encloses a back line 6, 8 and ensures that the bar does not sink when the kiter releases it. The two back lines 6, 8 are each guided to one end portion of the bar and enter there into an enclosed or partially open hollow profile 10 of the bar. The back lines are then redirected inside the hollow profile 10 and/or guided to a winder, which is located at the right end portion, i.e. in the transition area of the floater 2 to the hollow profile 10. As described in the prior art, this winder (also called a trimming device) has a drum on which the back lines 6, 8 are wound. These back lines 6, 8 can also be designed to be continuous, so that a central section is connected to the drum.

In order to operate the winder, the bar is provided with an electric motor 12, which is either integrated in the housing of the bar end or is attached to it. This electric motor drives the winder or respectively its drum directly or via a transmission in order to wind or unwind the back lines 6, 8. A button or slider 14 can be provided to operate the electric motor 12, which, for example, can be adjusted upwards in the direction of the kite for extending and downwards in the direction of the kiter for shortening, so that the direction of rotation of the winder is determined accordingly. This button 14 is located in an area of the bar 1 which is easily accessible by the kiter during kiting in order to be able to react quickly to wind changes.

The electric motor 12 is supplied with power by a battery 16, which is integrated into the hollow profile 10, for example. As indicated by the dashed lines in FIG. 1, the battery 16' can also be placed at another location of the hollow profile 10. In principle, it is also possible to arrange two batteries symmetrically for weight distribution. These batteries 16, 16' can either be exchangeably mounted and/or can be charged via a charger connection 18, for example by means of a USB connection or a contactless charging station 20. This charging station can in turn be equipped with a large battery, so that charging is also possible independent of the power grid.

In the event that the battery 16 is defective or has not been charged due to inattentiveness on the part of the kiter, the bar 1 is configured with an emergency actuation, which can consist of, for example, a winder handle being provided in a manner known per se, which still allows the kite to be trimmed in the event of a power failure. In a simpler solution, in addition to the button 14, a mechanical button can be provided via which the winder is mechanically unlocked so that the two back lines 6, 8 are extended and the kite correspondingly assumes its flattest trim position, with which the kiter can then return to charge the battery.

In one version, the bar 1 is additionally equipped with a radio module 24, which makes it possible to receive the signal of a radio station, e.g. a remote control 26, so that a kite instructor, for example, has the possibility to control the winder/trimming device from the beach in order to trim the kite in an optimal way for the respective student.

The bar depicted in the FIGURE also has two front lines 28, 30, which are combined to form a depower line 32. This line extends through a bushing 34 of the bar 1 towards a chicken loop 36. On the depower line 32, a stopper 38 is also adjustably guided, which limits the path of the bar 1 when it is released.

Approximately in the middle of the bushing 34, a display 40 is provided on the hollow profile 10 or respectively on the bar 1, on which essential function parameters, e.g. the line length, the charge state of the battery or also—with suitable sensors—information about the speed, the course and/or the altitude (in case of a jump) can be read. The power supply for this display is also provided by the battery or batteries 16.

Of course, a conventional mechanical display can also be used instead of the electrical display to show the current line length in the usual way. The charge state of the battery can also be indicated by diodes or the like.

A bar for steering a kite is disclosed. This bar is configured with a trimming device for the back lines (back-line trimming device), which is adjustable by a motor, preferably an electric motor.

LIST OF REFERENCE SIGNS

1 bar
2 floater
4 floater
6 back line
8 back line
10 hollow profile
12 electric motor
14 button/slider
16 battery
18 charger connection
20 charging station
22 winder handle
24 radio module
26 remote control
28 front line
30 front line
32 depower line
34 bushing
36 chicken loop
38 stopper
40 display

The invention claimed is:

1. A bar for steering a kite, comprising:

two front lines which can be connected to a chicken loop, and two back lines which are guided out of end portions of the bar and whose length can be adjusted for trimming the kite by means of a trimming device, which is configured as a winder or winch and associated with the two back lines, mounted in or on the bar, wherein the trimming device is adjusted by a motor and has a mechanical emergency actuation configured as a rotary winder handle.

2. The bar according to patent claim 1, wherein adjusting the trimming device is carried out by means of an electric motor which is supplied with power via a battery.

3. The bar according to claim 2, wherein the battery is replaceably held in or on the bar.

4. The bar according to claim 2, wherein the electric motor is held in or on the bar.

5. The bar according to claim 2, having a charger connection for connecting the battery to a charging station.

6. The bar according to claim 2, having a radio module, via which the electric motor can be controlled by remote control.

7. The bar according to claim 2, with an electric display for indicating function parameters.

8. The bar according to claim 7, wherein the function parameters include at least one of the line length or a battery charge.

9. A system comprising:

the bar according to claim 2; and a charging station for charging the battery by cable or without contact.

* * * * *